US007207838B2

(12) United States Patent
Andreescu

(10) Patent No.: US 7,207,838 B2
(45) Date of Patent: Apr. 24, 2007

(54) COAXIAL CONNECTORS

(75) Inventor: Paul Andreescu, Namur (BE)

(73) Assignee: SEE SPRL, Braine-l'Alleud (BE)

( * ) Notice: Subject to any disclaimer, the term of this patent is extended or adjusted under 35 U.S.C. 154(b) by 0 days.

(21) Appl. No.: 11/025,139

(22) Filed: Dec. 30, 2004

(65) Prior Publication Data

US 2006/0148315 A1 Jul. 6, 2006

(51) Int. Cl.
*H01R 9/05* (2006.01)

(52) U.S. Cl. ..... 439/583

(58) Field of Classification Search ..... 439/578–585, 439/429, 805, 811, 277–279, 474–475, 274–275
See application file for complete search history.

(56) References Cited

U.S. PATENT DOCUMENTS

| | | | | |
|---|---|---|---|---|
| 5,284,449 | A | 2/1994 | Vaccaro | |
| 5,595,502 | A * | 1/1997 | Allison | 439/429 |
| 5,993,254 | A | 11/1999 | Pitschi et al. | |
| 5,997,350 | A * | 12/1999 | Burris et al. | 439/585 |
| 6,102,738 | A * | 8/2000 | Macek et al. | 439/584 |
| 6,109,964 | A | 8/2000 | Kooiman | |
| 6,133,532 | A | 10/2000 | Lundback et al. | |
| 6,331,123 | B1 | 12/2001 | Rodrigues | |
| 6,890,208 | B2 * | 5/2005 | McCarthy | 439/394 |
| 6,976,872 | B1 | 12/2005 | Wild et al. | |
| 2002/0193005 | A1 | 12/2002 | Takayoshi et al. | |

FOREIGN PATENT DOCUMENTS

| | | |
|---|---|---|
| FR | 2682819 | 4/1993 |

* cited by examiner

*Primary Examiner*—Truc T. Nguyen
*Assistant Examiner*—Edwin A. Leon
(74) *Attorney, Agent, or Firm*—Dykema Gossett PLLC

(57) ABSTRACT

A coaxial connector mountable on an end of a coaxial cable having a central conductor (cc) and an exterior conductor (ce), the connector comprising a first conductive contact element (2; 27; 38; 40) for contacting the central conductor (cc), a second conductive contact element (4; 21; 302; 411) for contacting the exterior conductor (ce) electrically isolated from the first contact element, a clamping member (5; 22; 42) opposing the second contact element for clamping the exterior conductor against the second contact element and a force applying member (6; 23; 441) for forcing the clamping member and the second contact element towards each other, wherein the second contact element and/or the clamping member comprise at least one deforming member (502; 222–223; 423–424) for deforming the exterior conductor (ce) under influence of the force applying member, wherein each deforming member (502; 222–223; 423–424) is constructed in a material with a predetermined hardness above that of the material of the exterior conductor and has a predetermined shape for hardening a portion of the exterior conductor to such an extent that it becomes substantially fully elastic.

27 Claims, 4 Drawing Sheets

COAXIAL CONNECTORS

BACKGROUND OF THE INVENTION

1. Field of the Invention

The present invention relates to coaxial connectors mountable on an end of a coaxial cable having a central conductor and an exterior conductor.

All the materials which are used in fabricating coaxial cables, the metals as well as the plastics, are non-elastic materials. The fixing onto the cable, the sealing and the electric contacts are functions which are realised by forces between the elements of the cable and the elements of the connector during the mounting of the latter on the cable. The majority of existing connectors use rigid elements for applying the necessary forces for realising one or more of the functions, which leads to a material flow which consists of a cold deformation for eliminating mechanical stress. The forces diminish to an extent which is insufficient for the respective function. An other problem of existing connectors is the use of an internal threaded part for holding the exterior conductor of the cable. Such internal threaded part creates grooves in the outer conductor which can break the connection. For certain cables with a fragile exterior conductor, for example a braid of metallic strands, rigid contact systems are used which press the fragile conductor against the dielectric on the interior thereof, with the same risk of possible breakage. Furthermore, the deformation of the cross-section of the cable by this type of gripping can modify the impedance of the cables and disturb the transmission of the signal. All these disadvantages of rigid contact elements are increased in the field as a result of temperature variations and vibrations.

2. The Prior Art

From EP-A-897 202 a coaxial connector is known, comprising a head portion having a recess which has one end formed with a first ring surface for establishing a contact from inside with an end zone of an outer cable conductor of a coaxial cable, and a restraint for the coaxial cable. The restraint is formed by a clamp bushing having a head portion side end formed with a second ring surface for clamping the end zone of the outer cable conductor from outside, and a pressure-applying member enclosing the cable and fastened to the head portion for forcing the clamp bushing in the axial direction against the first ring surface and to thereby clamp the end zone of the outer cable conductor between the first and second ring surfaces. At least one of the ring surfaces is formed with at least one annular bead which projects in the direction of a respective area of the end zone of the outer cable conductor and is defined by a height of approximately 5 to 30% of a wall thickness of the outer cable conductor. Upon tightening of the connector around the cable, this annular bead causes a plastic deformation of the outer conductor.

The coaxial connector known from EP-A-897 202 however has the disadvantage that the electrical contact between the outer cable conductor and the head portion may deteriorate in time.

It is a first aim of this invention to provide a coaxial connector in which the deterioration in time of the electrical contact with the outer cable conductor can be reduced.

It is a second aim of the invention to provide a coaxial connector with enhanced cable retention.

It is a third aim of the invention to provide a coaxial connector with an enhanced seal against penetration of moisture.

SUMMARY OF THE INVENTION

The first aim is achieved according to the invention with a coaxial cable conductor comprising a first conductive contact element for contacting the central conductor, a second conductive contact element for contacting the exterior conductor electrically isolated from the first contact element, a clamping member opposing the second contact element for clamping the exterior conductor against the second contact element and a force applying member for forcing the clamping member and the second contact element towards each other, wherein the second contact element and/or the clamping member comprise at least one deforming member for deforming the exterior conductor under influence of the force applying member, wherein each deforming member is constructed in a material with a predetermined hardness above that of the material of the exterior conductor and has a predetermined shape for hardening a portion of the exterior conductor to such an extent that it becomes substantially fully elastic.

In other words, the connector of the invention has elements for compressing a portion of the exterior conductor, thereby deforming it beyond its plastic deformation capability. This leads to a local hardening of the material of the exterior conductor in such a way that any further compression, however limited, is reversed when the contact is released, i.e. that the material can only be elastically further compressed and has the intention to return to its original shape. This has the advantage that the electric contact at this hardened portion can adapt itself to pressure changes and remain excellent over a longer period in time. Due to the elasticity which is gained, any material flow which entails a reduction of the contact pressure is overcome by an expansion of the hardened, elastic part of the exterior conductor. Furthermore, due to the hardening of the material, this portion of the exterior conductor is less susceptible to material flow, so that an excellent electric contact over a very long period of time is achievable.

In a preferred embodiment, one deforming member is formed by a step edge between a first and a second contact surface of the second contact element or the clamping member, the step edge having a predetermined height corresponding to at least one third of a wall thickness of the exterior conductor. Alternatively, one deforming member may also be formed by a narrow shoulder which has a predetermined height corresponding to at least one third of a wall thickness of the exterior conductor. The local reduction of the wall thickness of the exterior conductor by at least one third of its original wall thickness, which is more than the 5 to 30% known from the prior art, can assure that this portion of the exterior conductor is hardened to the desired extent.

The first aim of the invention is furthermore achieved with a connector comprising a first conductive contact element for contacting the central conductor, a second conductive contact element for contacting the exterior conductor electrically isolated from the first contact element, and a clamping member for clamping the exterior conductor against the second contact element, wherein the clamping member is constructed in an elastically deformable, substantially incompressible material.

By constructing the clamping member in such a material, the same principle as with the local hardening of the exterior conductor as has been described above exists, namely that the electric contact between the exterior conductor and the second contact element is under the influence of an element, here the clamping member, which is elastically deformed and has the intention to regain its original shape. As a result, the contact can adapt itself to pressure changes which may for example be caused by material flow and an excellent electric contact over a very long period of time is achievable.

In a preferred embodiment, the second contact element comprises a groove for accommodating a deformation of the exterior conductor under the influence of the clamping member. This has the advantage that the exterior conductor is deformed into the groove, which can contribute to cable retention.

The second aim of the invention is furthermore achieved in that the connector comprises a permanently deformable split ferrule with conical outer surface complementary to a conical inner surface of a ring and is axially slidable for tightening the split ferrule around the cable, wherein the conical surfaces are directed such that a pull force on the cable causes a further tightening of the ferrule. In this way a pull force on the cable increases the grip of the connector onto the cable, so that excellent cable retention is achievable.

The third aim of the invention is achieved with a coaxial cable comprising one or more O-rings for sealing the interior of the connector against penetration of moisture, wherein the O-rings are compressed both radially and axially upon mounting the connector onto the cable. The compression of the O-rings in these two orthogonal directions can substantially enhance the seal which is formed by them.

It is furthermore an aim of this invention to provide a connector for each of the different types of available coaxial cables, in which the principles of the invention are applied. This and further aims will become apparent from the detailed description given below.

The invention will be further elucidated by means of the following description and the appended figures.

DETAILED DESCRIPTION OF THE PREFERRED EMBODIMENT

The coaxial connectors shown in the figures are intended for mounting on a coaxial cable which comprises a central conductor cc, a dielectric d surrounding the central conductor cc, an exterior conductor ce, cet, cef surrounding the dielectric d and an outer insulation g. As appears from the figures, solutions are presented for different types of coaxial cables which may be used in telecommunication, television distribution and other applications, particularly for connectors whose mounting cannot be effected by welding. In this case a plurality of categories exist: connectors which are mounted in the field, connectors for cables of large dimensions, connectors for cables with conductors whose metal is unsuitable for welding or for cables whose dielectric cannot resist the temperature of welding etc.

The coaxial connectors have to fulfil one or more of the following conditions: decent fixing on the cables, resistance to corrosion, and assuring good electric contacts. Their quality and life are directly linked to these parameters and particularly to the quality of the electric contact. The coaxial cables are very different from a viewpoint of utilised materials, constructional options and types of application. It is impossible to achieve a good connection with connectors having the same type of fixing, sealing and contact for all existing types of cables.

Figure 1:
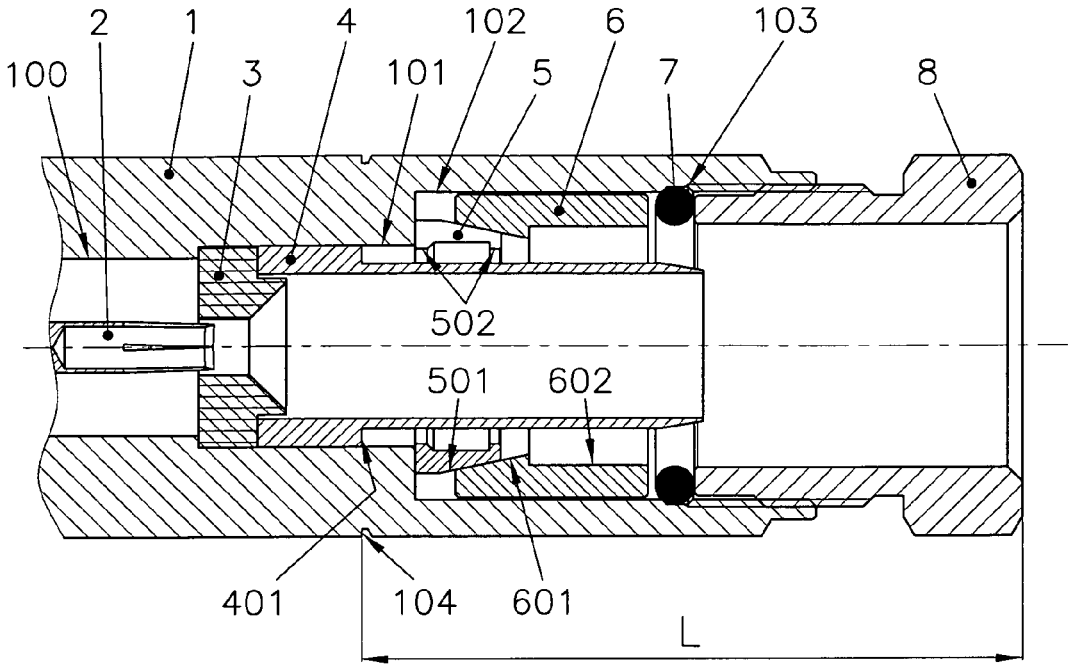
FIG. 1 shows a cross sectional view of a first embodiment of a coaxial connector according to the invention.

The first coaxial connector of FIG. 1 is intended for mounting on a coaxial cable having as exterior conductor ce a tube in extruded aluminium. The connector comprises a body 1 with a central bore comprising a first portion 100 at the front, which widens into a second portion 101 and further to a third portion 102 at the rear of the connector. In the interior of the first portion 100 of the central bore, a central elastic contact 2 is mounted, which is intended for making an elastic contact with the central conductor cc. For the purpose of clarity, the location of the central contact 2 is here called the "front" of the connector and the opposite side of the connector which faces the coaxial cable is called the "rear". A guide 3 for guiding the central conductor cc upon insertion into the central contact 2 is mounted in the second portion 101 of the central bore, in which portion also a mandrel 4 is fixed. This mandrel 4 extends towards the rear into the third portion 102 of the central bore and is provided for electrically connecting the exterior conductor ce to the body 1. In this third portion 102 of the bore, a ring 6 is mounted which is held in position by an O-ring 7, seated in a groove 103. Behind the groove 103, the body is provided with an internal thread which is complementary to an external thread on a rear part 8 of the connector, which is shown in a position in contact with the O-ring 7. The ring 6 has a conical entrance 601 facing the front of the connector. This conical entrance 601 is in contact with a corresponding conical outer surface 501 of a split ferrule 5, which is mounted on the interior of the ring 6. The ferrule 5 is on its interior provided with two narrow shoulders 502 which protrude towards the inside and are provided to be pressed into the outer surface of the exterior conductor ce. Behind the conical entrance 601, the ring 6 further comprises a cylindrical portion 602 which forms a passage for the outer insulation g of the coaxial cable.

Figure 2:
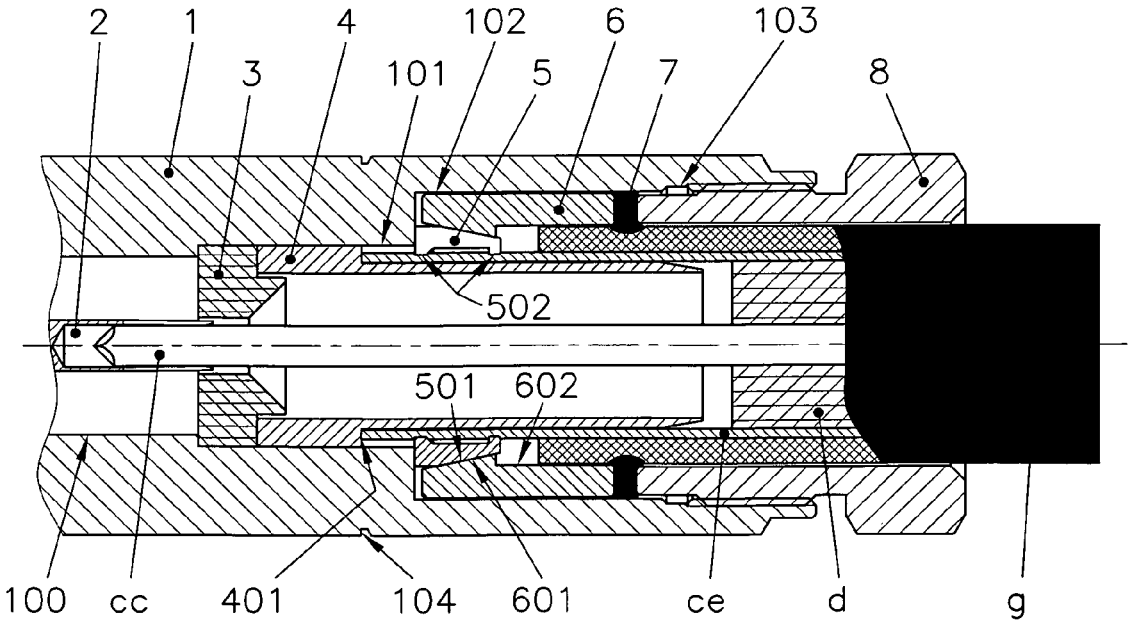
FIG. 2 shows a cross sectional view of the embodiment of FIG. 1, mounted on a coaxial cable.

The connector of FIG. 1 is a so-called monoblock connector, which means that the rear part 8 does not have to be removed from the body 1 for mounting the connector on the cable. For mounting the connector, one first places a reference mark on the prepared cable at a distance L measured from the front plane of the exterior conductor ce. This distance L is the distance between the end of the rear part 8 and the mark 104 which is provided on the outside of the body 1 and indicates the transverse plane of the surface 401 of the mandrel 4 against which the front plane of the exterior conductor ce is to abut. One places the connector on the cable and pushes it over the cable until the end of the rear part 8 arrives at the reference mark placed on the cable. In this way, it can be ensured that the cable is in the correct position on the inside of the connector, before the connector is fixed onto the cable by screwing the rear part 8 into the body 1. The use of the reference mark 104 avoids the need for dismantling the connector for verifying if the cable is in the correct position. FIG. 2 shows the connector of FIG. 1 mounted and fixed on the cable.

The first connector of FIG. 1 functions as follows. By screwing the rear part 8 into the body 1, it dislodges the O-ring 7 from the groove 103 while compressing it radially and pushing it into the third portion 102 of the central bore against the ring 6. The ring 6 is thereby moved towards the front and cooperates by means of its conical surface 601 with the conical surface 501 of the split ferrule 5 for tightening the latter against the exterior conductor ce of the cable. The angle of the two conical surfaces 601 and 501 being small, the tightening of the split ferrule 5 is caused with great force. The exterior conductor ce of the cable is deformed and pressed against the mandrel 4, which is fixed in the second portion 101 of the bore in the body, by the radial tightening force transferred via the two small shoulders 502 of the ferrule 5. These shoulders 502 break the aluminium oxide film, which forms an insulation, and as a result ensure a good electric contact. Moreover, by the large tightening force the exterior conductor ce is locally hammer-hardened to the extent that it becomes substantially fully elastic, so that an elastic contact is created between the exterior conductor ce and the mandrel 4 which can adjust itself to stress changes and thus can assure a good contact over a very long period of time. The hardening of the exterior conductor ce makes it also less sensible to cold metal flow. The exterior conductor ce is hardened by the shoulders 502, but it is not cut by them. Cuts are to be avoided since they could lead to breakage upon occurrence of vibrations.

From a mechanical point of view, the tightening of the exterior conductor ce by the split ferrule 5 around the mandrel 4 can assure the fixing of the connector and the retention of the cable. Since the shoulders 502 enter into the exterior conductor ce when the ferrule 5 is tightened for the first time and the ferrule 5 remains in position when the tightening force is released, i.e. when the rear part 8 is screwed out, the ferrule 5 fixes the connector on the cable. When the rear part 8 is screwed out, the connector becomes axially rotatable around the cable end but is advantageously held in position on the cable end. The conical entrance 601 of the ring 6, which is provided for tightening the ferrule 5, has a diameter which shortens from the front towards the rear of the connector. This has the effect that in the tightened state, i.e. with the rear part 8 screwed into the body 1, any pull force on the cable tightens the ferrule 5 even more around the exterior conductor ce, so that excellent cable retention is achieved.

The O-ring 7 also has both a mechanical and an electric function. In the tightened state, the O-ring 7 substantially completely fills the space between the third portion 102 of the bore, the ring 6, the rear part 8 and the outer insulation g of the cable, and functions like the joint of a stuffing box, assuring an excellent seal between the cable and the connector which can adapt itself to variations in the thickness of the insulation g of the cable. A seal is also obtained between the exterior conductor ce and the insulation g of the cable, which penetrates into the passage 602 of the ring 6, which is very important for preventing the entrance of moisture into the connector which can be located between a damaged part of the insulation g and the exterior conductor or the penetration of compound in case the cable is of the compound containing type. The pressure of the O-ring 7 onto the insulation g of the cable is of such an extent that it is transferred onto the exterior conductor ce which is in turn tightened and deformed around the mandrel 4. Thus the O-ring 7 contributes to the electric contact between the exterior conductor ce and the mandrel 4. Since the elastomer of the O-ring 7 is elastic but substantially incompressible, it has a tendency to regain its original form in cross-section as does any elastic element, so that the O-ring exerts a self-adjusting pressure on the cable and creates a second elastic contact between the exterior conductor ce and the mandrel 4, which can compensate a possible flow. Due to the double elastic contact created by on the one hand the hammer-hardened part of the exterior conductor ce and on the other hand the elastic O-ring 7, which can both compensate for material flow, as well as due to the large contact forces, an excellent long term electric contact is achievable.

Figure 3:
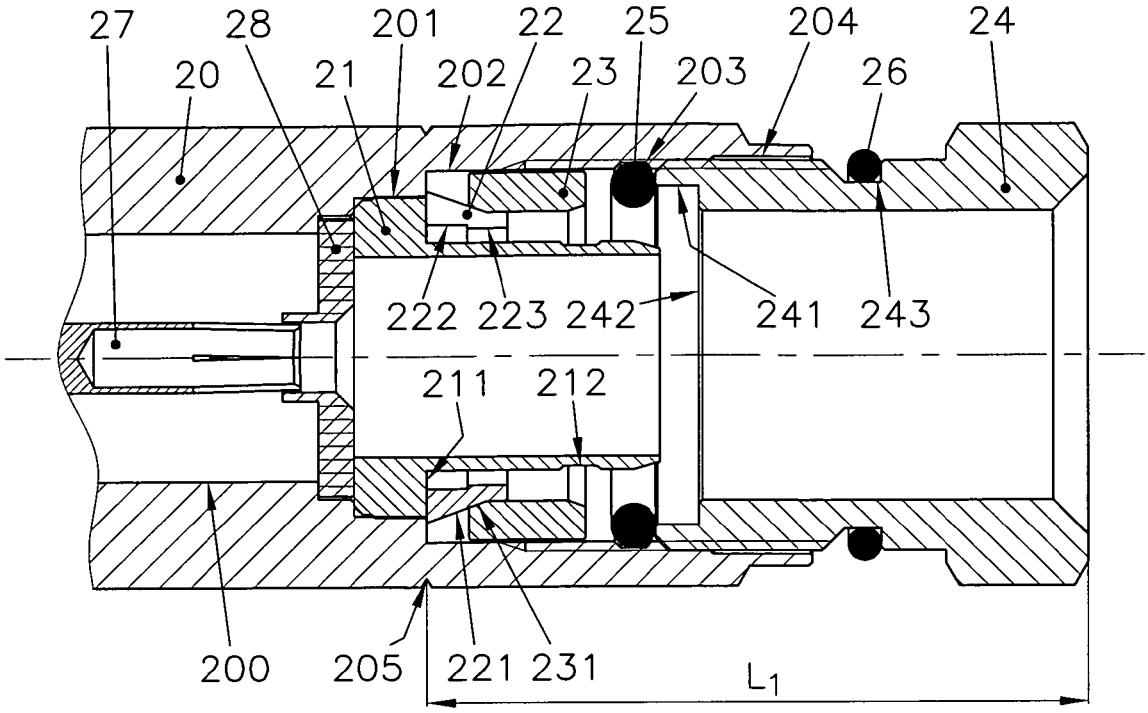
FIG. 3 shows a cross sectional view of a second embodiment of a coaxial connector according to the invention.

The second coaxial connector of FIG. 3 is intended for mounting on a coaxial cable having as exterior conductor ce a fine malleable tube in welded aluminium. The connector comprises a body 20 with a central bore comprising a first portion 200 at the front, which widens into a second portion 201 and further to a third portion 202 and a fourth portion 204 at the rear of the connector. In the interior of the first portion 200 of the central bore, a central elastic contact 27 is mounted, which is intended for making an elastic contact with the central conductor cc. Again a guide 28 is provided for guiding the central conductor cc upon insertion into the central contact 27. In the second portion 201 of the central bore, a mandrel 21 is fixed, which is provided for electrically connecting the exterior conductor ce to the body 20. This mandrel 21 extends towards the rear into the third portion 202 of the central bore where it comprises an outer groove 212. In this third portion 202 of the bore, a ring 23 is mounted which is held in position by an O-ring 25, seated in a groove 203. Behind the groove 203, the body is provided with an internal thread which ends at the fourth portion 204 of the bore. The internal thread of the body 20 is complementary to an external thread on a rear part 24 of the connector, which is shown in a position in contact with the O-ring 25. The rear part 24 comprises an outer groove 243 in which a further O-ring 26 is seated for forming a seal in the fourth portion 204 of the body 20. The ring 23 has a conical entrance 231 facing the front of the connector. This conical entrance 231 is in contact with a corresponding conical outer surface 221 of a split ferrule 22, which is mounted on the interior of the ring 23. The ferrule 22 is on its interior provided with two central bore portions 222 and 223 which have a different diameter, forming a step of about one third of the thickness of the exterior conductor ce. This step edge and the front edge of the wider diameter portion 222 are provided to be pressed into the outer surface of the exterior conductor ce upon tightening the ferrule 21.

Figure 4:
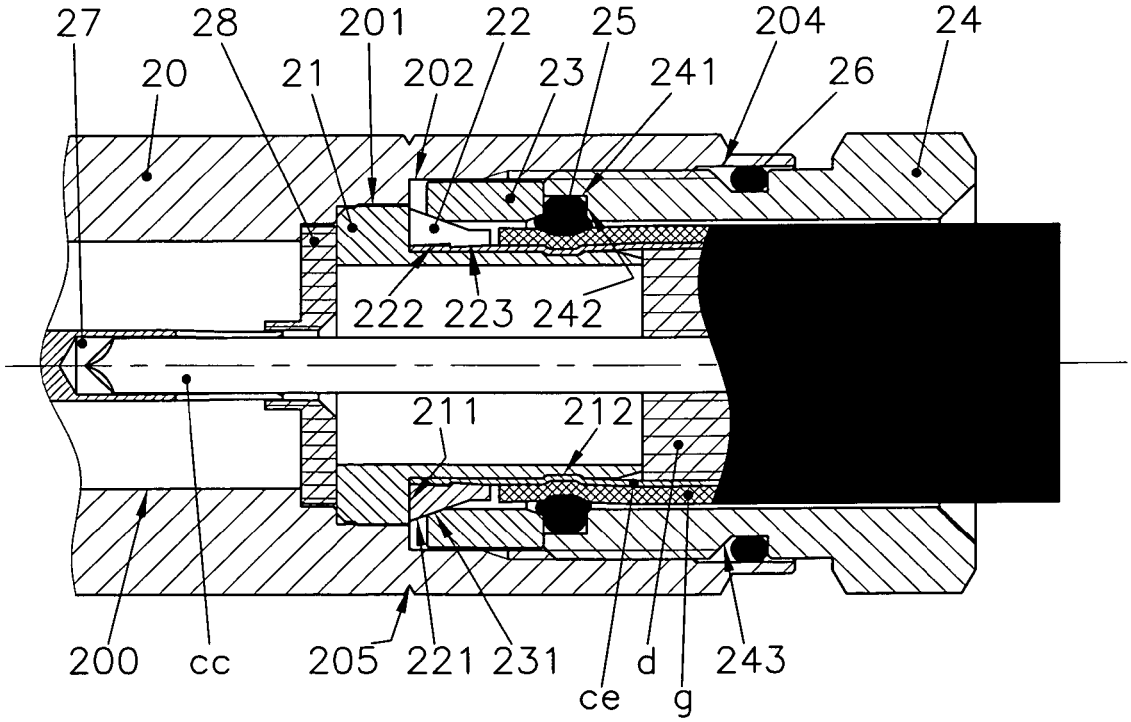
FIG. 4 shows a cross sectional view of the embodiment of FIG. 3, mounted on a coaxial cable.

This second connector is also a monoblock connector whose rear part 24 does not have to be removed for mounting the connector on the cable. This is done by placing a reference mark on the prepared cable on a distance L1 measured from the front plane of the exterior conductor ce. This distance L1 is the distance between the end of the rear part 24 and the mark 205 which is provided on the outside of the body 20 and indicates the transverse plane of the surface 211 of the mandrel 21 against which the front plane of the exterior conductor ce is to abut. One places the connector on the cable and pushes it over the cable until the end of the rear part 24 arrives at the reference mark placed on the cable. In this way, it can be ensured that the cable is in the correct position on the inside of the connector, before the connector is fixed onto the cable by screwing the rear part 24 into the body 20. The use of the reference mark 205 avoids the need for dismantling the connector for verifying if the cable is in the correct position. FIG. 4 shows the connector of FIG. 3 mounted and fixed on the cable.

The second connector of FIG. 3 functions as follows. By screwing the rear part 24 into the body 20, it dislodges the O-ring 25 from the groove 203 while compressing it radially and pushing it into the third portion 202 of the central bore against the ring 23. The rear part 24 is screwed further so that the O-ring is moved into an entrance 241 for containing the O-ring 25 which is provided in the rear part 24. This entrance 241 has a slightly smaller diameter than the third portion 202 of the bore, so that the O-ring 25 is further radially compressed when it is pushed into this entrance 241. By further screwing the rear part 24 into the body 20, the O-ring 25 is axially compressed between the ring 23 and the rear part 24 and the ring 23 is also moved towards the front. The ring 23 cooperates by means of its conical surface 231 with the conical surface 221 of the split ferrule 22 for tightening the latter against the exterior conductor ce of the cable. The angle of the two conical surfaces 231 and 221 being small, the tightening of the split ferrule 22 is caused with great force. This causes the ferrule 22 to slightly tilt, so that both the front edge of the wider bore 222 and the front edge of the narrower bore 223 of the ferrule 22 come into contact with the exterior conductor ce and are pressed into it, breaking the aluminium oxide film. As a result, the exterior conductor ce of the cable is again deformed and pressed against the mandrel 21 by the radial tightening force transferred via the two sharp interior edges of the ferrule 22. By the large tightening force the exterior conductor ce is locally hammer-hardened to the extent that it becomes substantially fully elastic, so that an elastic contact is created between the exterior conductor ce and the mandrel 21 which can adjust itself to stress changes and thus can assure a good contact over a very long period of time. The hardening of the exterior conductor ce makes it also less sensible to cold metal flow.

From a mechanical point of view, the tightening of the exterior conductor ce by the split ferrule 22 around the mandrel 21 can again assure the fixing of the connector as well as the retention of the cable. Since the edges on the interior of the ferrule 22 enter into the exterior conductor ce when it is tightened for the first time and the ferrule 22 remains in position when the tightening force is released, i.e. when the rear part 24 is screwed out, the ferrule 22 fixes the connector on the cable. When the rear part 24 is screwed out, the connector becomes axially rotatable around the cable end but is advantageously held in position on the cable end. The conical entrance 231 of the ring 23, which is provided for tightening the ferrule 22, has a diameter which shortens from the front towards the rear of the connector. This has the effect that in the tightened state, i.e. with the rear part 24 screwed into the body 20, any pull force on the cable tightens the ferrule 22 even more around the exterior conductor ce, so that excellent cable retention is achieved.

The O-ring 25 again has various functions. In the tightened state, the O-ring 25 substantially completely fills the space between the entrance 241 of the rear part 24, the ring 23 and the outer insulation g of the cable, and functions like the joint of a stuffing box, assuring an excellent seal between the cable and the connector. A seal is also obtained between the exterior conductor ce and the insulation g of the cable, which penetrates underneath the ring 23, which is very important for preventing the entrance of moisture into the connector which can be located between a damaged part of the insulation g and the exterior conductor or the penetration of compound in case the cable is of the compound containing type. The sealing between the rear part 24 and the body 20 of the connector is assured by the second O-ring 26. The pressure of the first O-ring 25 onto the insulation g of the cable is of such an extent that it is transferred onto the exterior conductor ce which is in turn tightened and deformed by entering into the groove 212 in the mandrel 21. Thus the O-ring 25 contributes to the electric contact between the exterior conductor ce and the mandrel 4 and also to retention of the cable. Since the elastomer of the O-ring 25 is elastic but substantially incompressible, it has a tendency to regain its original form in cross-section as does any elastic element, so that the O-ring exerts a self-adjusting pressure on the cable and creates a second elastic contact between the exterior conductor ce and the mandrel 21, which can compensate a possible flow. Due to the double elastic contact created by on the one hand the hammer-hardened part of the exterior conductor ce and on the other hand the elastic O-ring 25, which can both compensate for material flow, as well as due to the large contact forces, an excellent long term electric contact is achievable.

An important advantage of the monoblock construction of the two connectors described above exists if the connectors are provided with standard screwable heads or interfaces (not shown) for connecting the cable to further equipment. When it is desired to remove the cable from said equipment, one unscrews the rear part 8, 24 for releasing all the tensions or pressures onto the cable. At that moment, the connector can be unscrewed from the equipment since an axial rotation of the connector around the cable is enabled, as has been described above. This rotation does not damage the surfaces which provide the electric contacts, since the tensions are released. But the connector remains in position on the cable end. For remounting the cable on the equipment it is then sufficient to screw the connector head back on and then to screw the rear part 8, 24 back into the body 1, 20 for retightening the connector on the cable. The result is substantially identical to the result after the first mounting.

Figure 5:
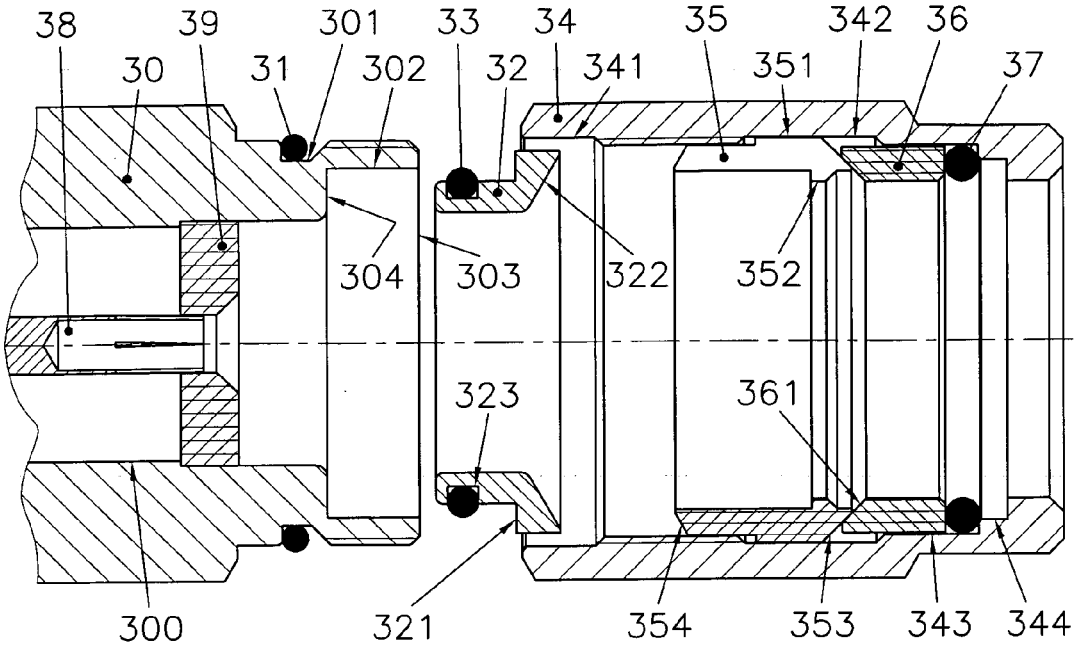
FIG. 5 shows a cross sectional view of a third embodiment of a coaxial connector according to the invention.

The third coaxial connector shown in FIG. 5 is intended for mounting on a coaxial cable having as exterior conductor cet a braid of very fine metallic strands. This connector is however also suitable for cables whose exterior conductor is composed of two layers, respectively a metal strip cef below the braid cet. The connector again comprises a body 30 with a central bore with a front portion 300 in the interior of which a central elastic contact 38 is mounted, which is intended for making an elastic contact with the central conductor cc. Again, a guide 39 is provided for guiding the central conductor cc upon insertion into the central contact 38. The body 30 ends in an externally threaded portion, in front of which an outer groove 301 is provided, holding an O-ring 31 for forming a seal with a rear part 34. A rear portion 302 of the central bore, extending in the interior of the externally threaded portion of the body 30, is provided for accommodating a ring 32. This ring has an external groove 323 in which an O-ring 33 is held, which functions to hold the ring substantially in the centre of the rear portion 302 of the bore in the body. The ring 32 has at its rear end an upstanding contact surface 321 for contacting the end surface 303 of the body 30. When these surfaces 321 and 303 are in contact, a narrow gap is formed between the ring 32 and the front wall 304 of the rear bore portion 302. The connector further comprises the rear part 34 which has a central bore successively comprising an entrance portion 341 for surrounding the body 30 at the O-ring 31, an internally threaded portion corresponding to the externally threaded portion of the body 30, a first rear portion 342, a slightly narrower second rear portion 343 and a further narrower third rear portion 344. In the first rear portion 342 of the rear part 34, a split ferrule 35 is held with its outer surface 351 in contact with the inner wall of the portion 342.

The ferrule 35 again has an outer conical surface 353 at its rear end, cooperating with an inner conical surface 361 of a ring 36, which is located in the second rear portion 343. Behind the ring 36 in the same bore portion 343 another O-ring 37 is located for sealing purposes. All these parts are held in place in the rear part 34 by the ferrule 35. The ferrule 35 furthermore has an outer conical surface 354 at its front end which cooperates with an inner conical surface 322 of the ring 32.

Figure 6:
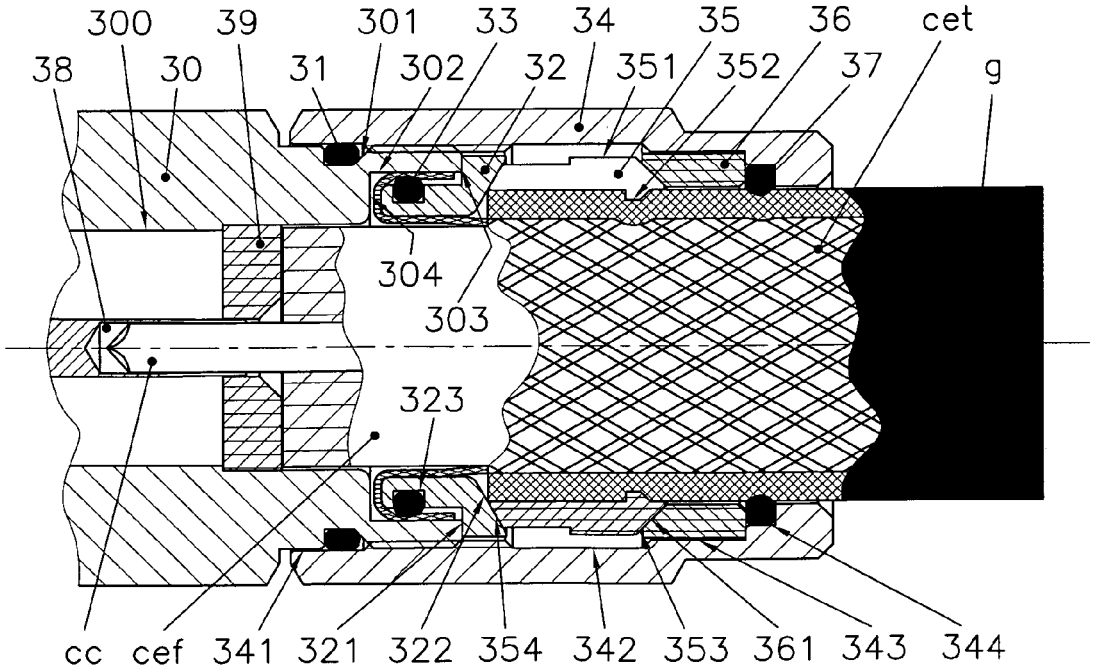
FIG. 6 shows a cross sectional view of the embodiment of FIG. 5, mounted on a coaxial cable.

For mounting the connector of FIG. 5 on the cable, the rear part 34 is taken and placed on the prepared cable. Then the ring 32 is taken and slid over the braid cet until it is in contact with the front of the insulation g, after which the braid cet is folded back over the O-ring 33 on the outside of the ring 32. The cable with the ring 32 is pushed into the body 30 for insertion into the rear bore portion 302 of the body 30. Finally the rear part 34 is screwed onto the body 30 and tightened. FIG. 6 shows the connector of FIG. 5 mounted on the cable.

The third connector of FIG. 5 functions as follows. The O-ring 33 on the outer groove 323 of the ring 32 presses the braid cet of the cable against the wall of the rear bore portion 302, assuring an electric contact between the braid cet and the body 30. This electric contact is furthermore elastic due to the elastic properties of the elastomer of the O-ring 33, but entails substantially no modification in the diameter of the cable so that its impedance remains substantially the same. Providing the electric contact by means of the O-ring also has the advantage that the connector body 30 is axially rotatable around the cable without damaging the exterior conductor cet (as long as the rear part 34 is not tightened), since the friction between the braid cet and the O-ring 33 is above that between the braid cet and the body 30. By screwing the rear part 34 onto the body 30, the split ferrule 35 is tightened around the cable as a result of being pressed between the rings 32 and 36. The orientation of the corresponding conical surfaces 322 and 354 at the front of the ferrule 35 and the cooperating conical surfaces 361 and 353 at the rear is such that both rings 32 and 36 contribute to the tightening of the ferrule 35. The ferrule has an interior shoulder 352 which penetrates into the insulation g of the cable, thereby assuring retention of the cable. This shoulder is short and has a height of about one third of the thickness of the outer insulation g, so that the deformation in cross-section of the latter is insignificant. By the same movement, the ring 36 pushes the O-ring 37 into the third rear portion 344 of the bore in the rear part 34, which compresses the O-ring 37 radially. Afterwards, the O-ring 37 is also axially compressed so that it exerts a large pressure on the outer insulation g of the cable, thereby assuring a tight seal between the cable and the rear part 34. The seal between the body 30 and the rear part 34 is assured by the O-ring 31 which is tightened between the groove 301 and the entrance portion 341.

Figure 7:
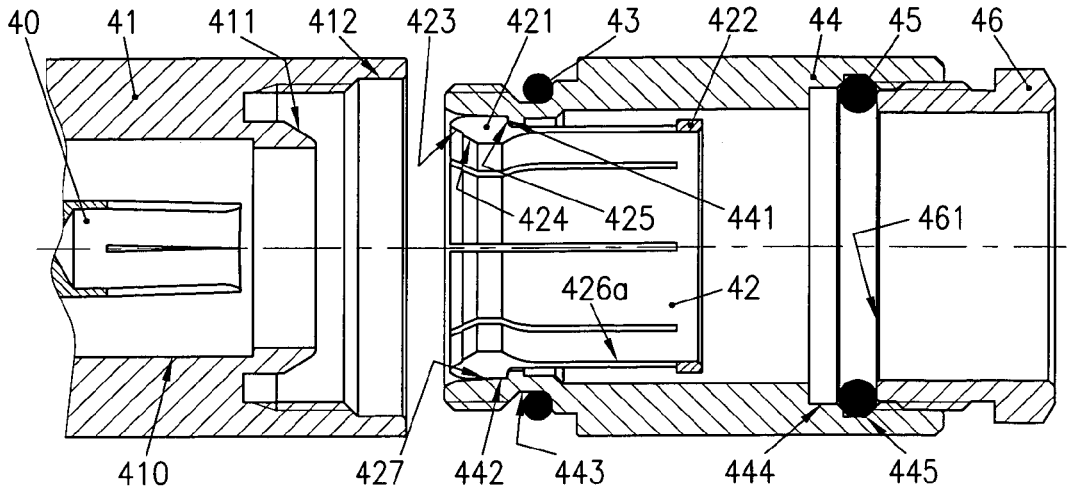
FIG. 7 shows a cross sectional view of a fourth embodiment of a coaxial connector according to the invention.

The fourth coaxial connector shown in FIG. 7 is intended for mounting on a coaxial cable having a corrugated exterior conductor ce. The connector comprises a body 41 and a rear part 44. The body is provided with a central bore, in the interior of which a central elastic contact 40 is mounted, which is intended for making an elastic contact with the central conductor cc. The central bore has an internally threaded portion followed by a rear portion 412 which are respectively intended for receiving a corresponding externally threaded front portion of the rear part 44 and a sealing O-ring 43 which is seated in an outer groove 443 of the rear part 44. The body 40 further comprises a conical surface 411 for contacting the inside of the front end of the exterior conductor ce of the cable. The rear part 44 has an entrance bore portion 442 which is followed by an annular projection 441. A ferrule 42 is held in the rear part 44 by the projection 441 and is axially slidable along the projection 441. This ferrule 42 comprises a cylindrical crown 422 onto which a plurality of forwards projecting elastic fingers 426 are attached, which can be elastically bent from a neutral position **426*a* shown in FIG. 7 and in dashed lines in FIG. 9 to a position under stress 426*b* shown in FIG. 8 and in full lines in FIG. 9. Each finger 426 has a head 421 which has outer surfaces 427 and 425 abutting the entrance bore portion 442 and the annular projection 441 of the rear part 44 and two inner conical surfaces 423 and 424 for contacting the outside of the front end of the exterior conductor ce of the cable. An annular step edge is formed by a sudden decrease in diameter from the first, more frontal conical surface 423 and the second, more rearward conical surface 424 of the ferrule 42. This step edge has a height of about one third of the thickness of the exterior conductor ce. This step edge as well as the front edge of the first conical surface 423 are provided to penetrate into the exterior conductor ce, in a similar way as was described for the ferrule 22 of the connector of FIG. 3, when the ferrule heads 421 are tightened under the action of the projection 441 onto the abutting surface 425. To this end, the conical surfaces 423 and 424 are substantially parallel to the contact surface 411 on the body 41 when the fingers 426 are in the neutral state 426*a***.

Figure 8:
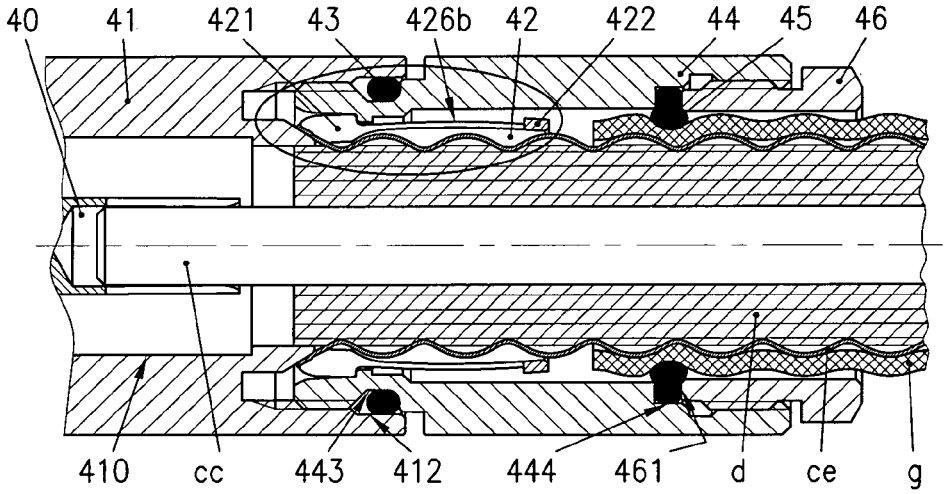
FIG. 8 shows a cross sectional view of the embodiment of FIG. 7, mounted on a coaxial cable.
Figure 9:
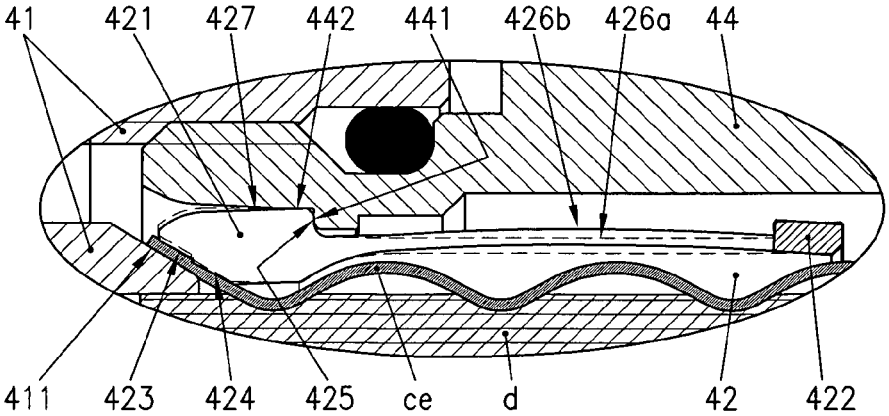
FIG. 9 shows a detail of FIG. 8.

For mounting the connector, first the rear part 44 is placed over the prepared cable. Then the body 41 is placed at the front of the cable with its surface 441 in contact with the inside of the exterior cable ce. Finally, the rear part 44 is screwed onto the body 41, thereby tightening the ferrule 42 and clamping the front end of the exterior conductor ce between the contact surface 411 of the body 41 and the ferrule heads 421. The result is shown in FIG. 8 and in detail in FIG. 9.

The functioning of the fourth connector is as follows. By screwing the rear part 44 onto the body 41, the ferrule 42 slides along the projection 441 until the upstanding outer surface 425 of the heads 421 abuts the projection 441. Further screwing has the effect that the projection 441 exerts a tightening force onto the heads 421, causing them to pivot slightly until the front edge of the first conical surface 423 comes into contact with the exterior conductor ce. This pivoting puts a given stress onto the fingers 426, causing them to take their position **426*b*. Next, the force exerted by the projection 441 onto the heads 421 causes the front edge and the step edge to penetrate into the material of the exterior conductor ce, thereby breaking the oxide film and locally hammer-hardening the exterior conductor ce to the extent that it becomes substantially fully elastic. As a result, an elastic contact is created between the exterior conductor ce and the body 41, which is enhanced by the stress on the elastic fingers 426. Thus, the elastic contact can adjust itself to stress changes and overcome material flow as a result of the achieved elasticity of the exterior conductor ce as well as the elasticity of the fingers 426. Since the front edge and the step edge of the ferrule 21** have entered into the material of the exterior conductor ce, again also an excellent cable retention is achievable.

In order to provide a seal also at the rear end of the rear part 44, a further O-ring 45 is seated in a groove 445. Behind this groove 445, the rear part 44 is provided with an internal thread which is complementary to an external thread on a further rear part 46 of the connector. By screwing the further rear part 46 into the rear end of the rear part 44, the O-ring 45 is dislodged from its groove 445 and moved to a narrower bore portion 444 and compressed radially around the outer insulation g of the cable.

In all the above described embodiments, the contact with the central conductor cc is achieved by introducing the latter possibly through a guide 3, 28, 39 into an elastic central contact 2, 27, 38, 40. This central contact 2, 27, 38, 40 is formed by a tightened tulip in elastic metal, whose petals are spread by the introduction of the central conductor cc, so that an elastic contact force is achieved. This assures electric contact without gripping the central conductor. This type of contact is very good over a long period of time and furthermore enables the rotation of the connector around the cable.

The invention claimed is:

1. A coaxial connector mountable on an end of a coaxial cable having a central conductor (cc) and an exterior conductor (ce), the connector comprising a first conductive contact element (2; 27) for contacting the central conductor (cc), a second conductive contact element (4; 21) for contacting the exterior conductor (ce) electrically isolated from the first contact element, a clamping member (5; 22) opposing the second contact element for clamping the exterior conductor against the second contact element and a force applying member (6; 23) for forcing the clamping member and the second contact element towards each other, wherein the at least one of the second contact element and the clamping member comprise at least one deforming member (502; 222–223) for deforming the exterior conductor (ce) under influence of the force applying member, wherein each deforming member (502; 222–223) is constructed in a material with a predetermined hardness above that of the material of the exterior conductor and has a predetermined shape for hardening a portion of the exterior conductor to such an extent that it becomes substantially fully elastic, wherein the second contact element (4; 21) forms part of a body (1; 20) and the force applying member (6; 23) is operated by a rear part (8; 24) which is screwably connected to the body, an elastically deformable O-ring (7;25) being mounted between the force applying member (6; 23) and the rear part (8; 24).

2. A coaxial connector according to claim 1, wherein the at least one deforming member is formed by at least one narrow shoulder (502) which has a predetermined height corresponding to at least one third of a wall thickness of the exterior conductor (ce).

3. A coaxial connector according to claim 1, wherein the O-ring (7; 25) is provided for sealing the interior of the connector against penetration of moisture.

4. A coaxial connector according to claim 1, wherein the connector comprises one or more additional O-rings (26) for sealing the interior of the connector against penetration of moisture, the additional O-ring being mounted at a location for being compressed between the rear part and the body or between the rear part and the cable.

5. A coaxial connector according to claim 1, wherein one deforming member is formed by a step edge between a first and a second contact surface (222–223) of the second contact element (21) or the clamping member (22), the step edge having a predetermined height corresponding to at least one third of a wall thickness of the exterior conductor (ce).

6. A coaxial connector according to claim 5, wherein a second deforming member is formed by a front edge of the first contact surface (222).

7. A coaxial connector according to claim 1, wherein the clamping member is formed by a deformable ferrule (5; 22) which is provided to be tightened around the exterior conductor (ce), thereby tightening the exterior conductor (ce) around the second contact element (4; 21), the force applying member (6; 23) acting on the outside of the ferrule (5; 22).

8. A coaxial connector according to claim 7, wherein the ferrule is a permanently deformable split ferrule (5; 22) with a conical outer surface (501; 221) complementary to a conical inner surface (601; 231) of a ring (6; 23) which forms the force applying member and is axially slidable for tightening the split ferrule (5; 22).

9. A coaxial connector according to claim 8, wherein the conical surfaces (501, 601; 221, 231) are directed such that a pull force on the cable causes a further tightening of the ferrule (5; 22).

10. A coaxial connector according to claim 1, wherein the O-ring (7; 25) upon screwing the rear part into the body is compressed both radially and axially.

11. A coaxial connector according to claim 10, wherein the O-ring (7; 25) is movable for the radial compression from a wider bore portion (103; 203) to a narrower bore portion (102; 202) having a reduced diameter.

12. A coaxial connector according to claim 11, wherein the O-ring (25) is further movable to an even narrower bore portion (241) having a further reduced diameter.

13. A coaxial connector according to claim 1, wherein the O-ring (25) is constructed of an elastically deformable, substantially incompressible material and forms a second contact clamping member for clamping the exterior conductor against the second contact element.

14. A coaxial connector according to claim 13, wherein the second contact element (21) comprises a groove (212) for accommodating a deformation of the exterior conductor under the influence of the O-ring (25).

15. A coaxial connector mountable on an end of a coaxial cable having a central conductor (cc) and an exterior conductor (ce), the connector comprising a first conductive contact element (27; 38) for contacting the central conductor (cc), a second conductive contact element (21; 302) for contacting the exterior conductor (ce) electrically isolated from the first contact element, and a clamping member (25; 33) for clamping the exterior conductor against the second contact element, wherein the clamping member (25; 33) is constructed of an elastically deformable, substantially incompressible material, wherein the second contact element (21; 302) forms part of a body (20; 30) and the clamping member (25; 33) is pushed onto the exterior conductor by a rear part (24; 34) which is screwably connectable to the body, thereby clamping the exterior conductor against the second contact element, wherein the clamping member is an O-ring (25) which is compressed both radially and axially upon clamping the exterior conductor, and wherein the O-ring (25) is movable for the radial compression from a wider bore portion (203) to a narrower bore portion (202) having a reduced diameter and further to an even narrower bore portion (241) having a further reduced diameter.

16. A coaxial connector according to claim 15, wherein said material is an elastomer.

17. A coaxial connector according to claim 15, wherein the second contact element (21) comprises a groove (212) for accommodating a deformation of the exterior conductor under the influence of the clamping member (25).

18. A coaxial connector according to claim 15, wherein the connector comprises one or more O-rings (25, 26; 31, 37) for sealing the interior of the connector against penetration of moisture, the O-ring being mounted at a location for being compressed between the rear part (24; 34) and the body (20; 30) or between the rear part (24; 34) and the cable.

19. A coaxial connector mountable on an end of a coaxial cable having a central conductor (cc) and an exterior conductor (ce), the connector comprising a first conductive contact element (27; 40) for contacting the central conductor (cc), a second conductive contact element (21; 411) for contacting the exterior conductor (ce) electrically isolated from the first contact element, a clamping member (22; 42) opposing the second contact element for clamping the exterior conductor against the second contact element and a force applying member (23; 441) for forcing the clamping member and the second contact element towards each other, wherein the at least one of the second contact element and the clamping member comprise at least one deforming member (222–223; 425–424) for deforming the exterior conductor (Ce) under influence of the force applying member, wherein each deforming member (222–223; 423–424) is constructed in a material with a predetermined hardness above that of the material of the exterior conductor and has a predetermined shape for hardening a portion of the exterior conductor to such an extent that it becomes substantially fully elastic, wherein one deformation member is formed by a step edge between a first and a second contact surface (222–223; 423–424) of the second contact element (21; 411) or the clamping member (22; 42), the step edge having a predetermined height corresponding to at least one third of a wall thickness of the exterior conductor (ce).

20. A coaxial connector according to claim 19, wherein a second deforming member is formed by a front edge of the first contact surface (222; 423).

21. A coaxial connector according to claim 19, wherein the clamping member is formed by a deformable ferrule (22; 42) which is provided to be tightened around the exterior conductor (ce), thereby tightening the exterior conductor (ce) around the second contact element (21; 411), the force applying member (23; 441) acting on the outside of the ferrule (22; 42).

22. A coaxial connector according to claim 21, wherein the ferrule (42) comprises a plurality of elastically deformable fingers (426) with heads (421) with conical inner surfaces (423–424) which comprise the at least one deforming member and with upstanding outer surfaces (425) on which the force applying member (441) acts, the second contact element (411) being formed by a conical surface complementary to the inner surfaces (423–424) of the ferrule heads (421).

23. A coaxial connector according to claim 22, wherein upon tightening the ferrule (42), the elastically deformable fingers (426) are elastically deformed from a neutral position to a position under stress in which they act like springs to maintain contact force.

24. A coaxial connector mountable on an end of a coaxial cable having a central conductor (cc) and an exterior conductor (ce), the connector comprising a first conductive contact element (27; 38) for contacting the central conductor (cc), a second conductive contact element (22; 302) for contacting the exterior conductor (ce) electrically isolated from the first contact element, and a clamping member (25; 33) for clamping the exterior conductor against the second contact element, wherein the clamping member (25; 33) is constructed in an elastically deformable, substantially incompressible material, wherein the second contact element (21; 302) forms part of a body (20; 30) and the clamping member (25; 33) is pushed onto the exterior conductor by a rear part (24; 34) which is screwably connectable to the body, thereby clamping the exterior conductor against the second contact element, wherein a permanently deformable split ferrule (35) with an internal annular shoulder (352) is mounted in the rear part (34) in between first and second rings (32, 36), the rings having conical inner surfaces (322, 361) directed towards each other and complementary to conical outer surfaces (354, 353) on both ends of the ferrule (35), the ferrule being provided to be tightened around the cable by movement of the rings towards each other as a result of screwing the rear part (34) onto the body (30), the ferrule being provided with an internal annular shoulder (352) for penetrating into an outer insulation (g) of the cable upon tightening of the ferrule (35).

25. A coaxial connector according to claim 24, wherein said material is an elastomer.

26. A coaxial connector according to claim 24, wherein the second contact element (21) comprises a groove (212) for accommodating a deformation of the exterior conductor under the influence of the clamping member (25).

27. A coaxial connector according to claim 24, wherein the connector comprises one or more O-rings (25, 26; 31, 37) for sealing the interior of the connector against penetration of moisture, the O-ring being mounted at a location for being compressed between the rear part (24; 34) and the body (20; 30) or between the rear part (24; 34) and the cable.

* * * * *